US011760395B2

(12) United States Patent
Norris

(10) Patent No.: US 11,760,395 B2
(45) Date of Patent: Sep. 19, 2023

(54) METHOD AND APPARATUS FOR RE-RAILING RAIL CARS

(71) Applicant: EL-TRAC HOLDING LLC, Canton, OH (US)

(72) Inventor: Christopher Glenn Norris, Sherrodsville, OH (US)

(73) Assignee: EL-TRAC HOLDING LLC, Canton, OH (US)

( * ) Notice: Subject to any disclaimer, the term of this patent is extended or adjusted under 35 U.S.C. 154(b) by 554 days.

(21) Appl. No.: 16/931,827

(22) Filed: Jul. 17, 2020

(65) Prior Publication Data

US 2021/0016809 A1 Jan. 21, 2021

Related U.S. Application Data

(60) Provisional application No. 62/876,318, filed on Jul. 19, 2019.

(51) Int. Cl.
*B61K 5/02* (2006.01)

(52) U.S. Cl.
CPC ..... *B61K 5/02* (2013.01)

(58) Field of Classification Search
CPC ..... B61K 5/04; B61K 5/02
See application file for complete search history.

(56) References Cited

U.S. PATENT DOCUMENTS

| | | | | |
|---|---|---|---|---|
| 2,158,352 A * | 5/1939 | Brown | B61K 5/00 | 104/126 |
| 4,606,273 A * | 8/1986 | Theurer | B61K 5/02 | 105/7 |
| 4,809,615 A * | 3/1989 | Brickett | B61D 15/02 | 105/72.2 |
| 5,203,264 A * | 4/1993 | Sodder, Jr. | B61K 5/02 | 104/263 |
| 5,743,190 A * | 4/1998 | Dinger | B61K 5/02 | 254/423 |
| 7,201,106 B2 * | 4/2007 | Whiston | B61D 15/00 | 105/72.2 |
| 9,981,672 B2 * | 5/2018 | McCulloch | B61K 5/02 | |

FOREIGN PATENT DOCUMENTS

| | | | |
|---|---|---|---|
| FR | 2854102 A1 * | 10/2004 | B60F 1/043 |
| KE | 100495029 B1 * | 6/2010 | B61K 5/02 |

* cited by examiner

*Primary Examiner* — Scott A Browne
(74) *Attorney, Agent, or Firm* — SAND, SEBOLT & WERNOW CO., LPA

(57) ABSTRACT

A method and apparatus of re-railing a rail car involving the use of one or more extendable arms carried by each individual rail car is provided. The extendable arms may be operable to extend outward from the rail car and then lower an extendable foot to contact the ground, thus allowing the car to be raised into position back over the rails of the associated train tracks utilizing these extendable arms. Since the arms are compact and carried by the rail car themselves, there is no time lost while lifting equipment is brought in and cars may be quickly and efficiently re-railed to minimize the overall time loss of the associated train tracks.

12 Claims, 14 Drawing Sheets

METHOD AND APPARATUS FOR RE-RAILING RAIL CARS

CROSS REFERENCE TO RELATED APPLICATIONS

This application claims the benefit of U.S. Provisional Application Ser. No. 62/876,318, filed on Jul. 19, 2019; the disclosure of which is incorporated herein by reference.

TECHNICAL FIELD

The present disclosure relates generally to the field of rail cars. More particularly, the present disclosure relates to a rail car having extendable arms for use in raising and lowering the rail car. Specifically, the present disclosure relates to a rail car having extendable arms for use in raising and lowering a rail car and to move the rail car laterally to align the wheels thereof with the rails of a train track.

BACKGROUND

Background Information

Rail cars, which are often referred to as train cars or railroad cars, come in many shapes and forms and are used for a multitude of transportation purposes. For example, rail cars may be used in the transport of goods and materials across a distance as part of a cargo or freight train, or may be used to transport people from one point to another as part of a passenger train. The different types of rail cars may include boxcars, flatcars, gondola cars, hopper cars, tank cars, passenger cars, and the like. Typically, rail cars refers to the cars in a train that are towed or otherwise pulled by an engine or locomotive and do not have their own drivetrain or source of driving power. Accordingly, they rely on these engines or locomotives to move them from one point to another.

As rail cars are being sorted for use in a train, they must be ordered and positioned according to the desired use. For example, if a cargo load is to be transported from a first location to a second location, the rail cars chosen are specific to that cargo. Typically, boxcars are used for goods that are desired to be kept in an enclosed structure and may include refrigeration units for fruits, vegetables, and the like, while flatcars may be used for large bulky loads, and gondola and/or hopper cars may be used for bulk goods, such as grains, stone, or the like. Tank cars are specialty cars used to transport liquids or gas. Therefore, a train carrying multiple types of goods typically utilizes multiple types of rail cars therein. Thus, in order to properly prepare a train for the expected load, it is common to use railyards to sort, load, and unload the rail cars prior to departing for the destination.

Railyards are a complex series of tracks that may include storage areas for rail cars when they are not being used, as well as areas for loading and unloading the cars. Rail cars are moved throughout the railyard by yard switchers, which are a type of locomotive designed specifically for this use. The railyard itself may have several series of tracks in parallel connected by switch points and the like. Often the tracks are arranged with several curved sections to bring the tracks together at common points to allow cars to be switched between track lines.

Additionally, many factories, such as steel mills, have rail lines on the property and in the buildings to transport materials around the premises or to locations off-site. It is common for such factories to have short sections of rail lines between large pieces of equipment to move heavy materials around using crane cars or engines. For example, in a steel mill molten steel is commonly moved from the furnace where it was melted down to an area to be processed by these rail lines.

It is common in railyards, and in factories having rail lines, for cars to derail during use. The most common of these derailments involve one or more wheels of a rail car disconnecting from the rail and are relatively minor events that do not result in significant damage or lost property. Despite this, derailments, particularly those that occur within a factory, cause significant delays and work stoppages, which in turn case economic harm to the parties involved. For example, when moving molten steel from the furnace to the processing machinery in a steel mill, a derailment may cause damage to the surrounding machinery if the molten metal is spilled. Further, as factory rail lines tend to be operated in tight spaces, the surrounding machines and work zones often need to be shut down while the derailment is handled, even if there is no damage to those areas. It is not uncommon for a minor derailing event to shut down an entire factory for a significant period of time while the crane car or engine is re-railed.

Currently, the common practice for handling a derailment involves bringing in heavy lifting equipment, such as a crane or other lifting device, to lift a rail car up off of the ground surface, realign the rail car with the rails of the track, and then lowering the rail car back into position. The crane or other heavy lifting equipment must then be moved out of the area before operations can resume. In some instances, if the rail car is laden with cargo, some or all of the cargo may need removed as to not exceed the limits of the lifting equipment available or, alternatively, heavier duty equipment must be brought in to account for the added weight of the cargo. If the lifting equipment is readily available and nearby, this process may be relatively quick, however, it may still result in lost use time for the particular train track, factory equipment, and equipment in the immediate vicinity of the derailment. Further, the lifting equipment itself may occupy or block other tracks or work stations, thus rendering them inoperable while the re-railing occurs. In instances where lifting equipment is not readily available or on hand and must be transported to the location, this re-railing process is known to take additional time including and up to a few days of lost use time for that track and any surrounding or otherwise affected tracks.

SUMMARY

The present disclosure addresses these and other issues by providing a method and apparatus of re-railing a rail car involving the use of one or more extendable arms carried by each individual rail car. The extendable arms may be operable to extend outward from the rail car and then lower an extendable foot to contact the ground, thus allowing the car to be raised into position back over the rails of the associated train tracks utilizing these extendable arms. Since the arms are compact and carried by the rail car themselves, there is no time lost while lifting equipment is brought in and cars may be quickly and efficiently re-railed to minimize the overall time loss of the associated train tracks.

In one aspect, the present disclosure may provide a rail car comprising: a body having a frame; a first longitudinal frame member to a first side of a centerline of the body; a first wheel assembly having at least one pair of wheels adapted to engage a pair of rails of a train track; a second wheel assembly having at least one pair of wheels adapted to engage the pair of rails of the train track; a first extendable arm having a first foot; a first hydraulic actuator operable to move the first extendable arm relative to the body; a second extendable arm having a second foot; and a second hydraulic actuator to move the second extendable arm relative to the body.

In another aspect, the present disclosure may provide a method of re-railing a rail car comprising: moving at least one extendable arm carried by the rail car from a stowed position to a deployed position; raising at least a portion of the rail car to a sufficient height to allow a wheel assembly carried by the rail car to be above the height of a rail pair of a train track via the at least one extendable arm and the foot; realigning at least one wheel of the wheel assembly with at least one of the rails in the rail pair via the at least one extendable arm; lowering the raised portion of the rail car until the at least one wheel contacts at least one rail in the rail pair via the foot; and moving the at least one extendable arm from the deployed position to the stowed position.

In another aspect, the present disclosure may provide a method of re-railing a rail car comprising: moving at least one of a plurality of extendable arms carried by the rail car from a stowed position to a first deployed position; lowering a foot from each of the plurality of extendable arms to contact a ground surface; raising at least a portion of the rail car to a sufficient height to allow a wheel assembly carried by the rail car to be above the height of a rail pair of a train track via the plurality of extendable arms and the feet; moving the raised portion of the rail car a first distance laterally relative to the train track via the plurality of extendable arms; raising the foot from a first arm of the plurality of extendable arms; moving the first arm of the plurality of extendable arms to a second deployed position; lowering the foot from the first arm of the plurality of extendable arms to contact the ground surface; raising the foot from a second arm of the plurality of extendable arms; moving the second arm of the plurality of extendable arms to a third deployed position; lowering the foot from the second arm of the plurality of extendable arms to contact the ground surface; and moving the raised portion of the rail car a second distance laterally relative to the train tracks.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
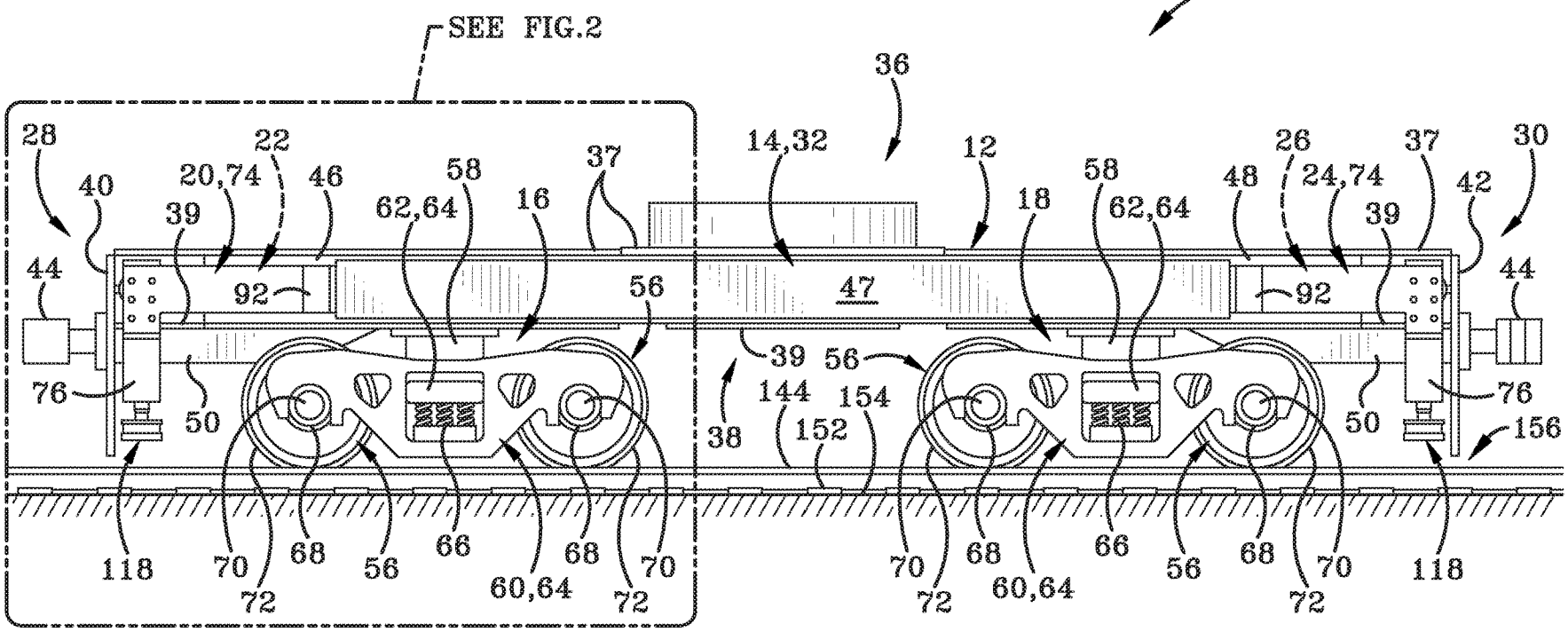
FIG. 1 is a side elevation view of a rail car according to one aspect of the present disclosure.
Figure 1A:
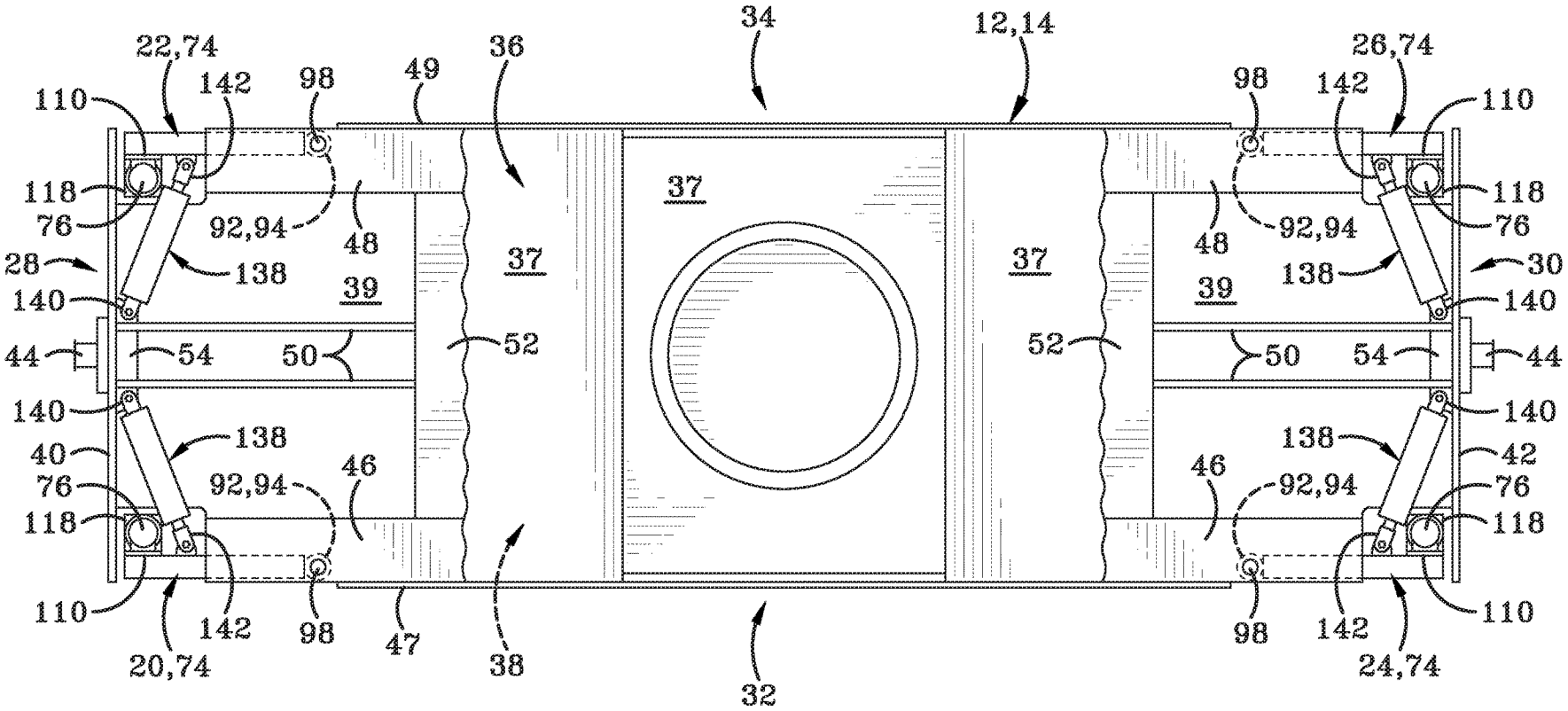
FIG. 1A is a top plan cut-away view of a rail car according to one aspect of the present disclosure.

With reference to FIGS. 1 and 1A, a rail car is shown and generally indicated at reference 10. The rail car 10 may have a body 12, a frame 14, first wheel assembly 16, and a second wheel assembly 18. Rail car 10 may further include at least one extendable arm illustrated in the figures as a first extendable arm 20, a second extendable arm 22, a third extendable arm 24, and a fourth extendable arm 26.

For simplicity, the body 12 of rail car 10 is shown in the figures as flatbed or otherwise unadorned rail car 10; however, it will be understood that the description and disclosure herein may be readily adapted for use with any type of rail car, including engines, cranes, boxcars, flatcars, gondola cars, hopper cars, tank cars, passenger cars, or the like. For continued simplicity of the disclosure, the body 12 will be further described with reference to the depicted flatcar as discussed further herein.

Body 12 therefore may include a first end 28 and a second end 30 which may be spaced apart and define a longitudinal direction therebetween. The longitudinal length of rail car 10 may be substantially parallel to the rails 144 of the associated train tracks 156 as discussed further herein. The longitudinal length of rail car 10 may further be indicative of the direction of travel (arrow D in FIG. 7A) of rail car 10. Body 12 may include a first side 32 which may be spaced apart from a second side 34 and define a lateral or transverse direction therebetween. The lateral or transverse direction may be substantially perpendicular to the train tracks 156 and/or direction of travel of the rail car 10. Body 12 may include a top 36 and a bottom 38 which may be spaced apart and define a vertical direction therebetween. Top 36 may include one or more top plates 37 that may form a platform on top 36 of body 12. Similarly, bottom 38 may further include one or more bottom plates 39. Top and bottom plates 37 and 39 may be modified according to the type of rail car 10 used. Body 12 may further have a first end plate 40 at first end 28 and a second end plate 42 at second end 30 thereof. The first and second end plates 40, 42 may be affixed to the frame 14 as discussed further herein and may provide a mounting point for a coupler 44 which may allow attachment to a neighboring rail car and/or locomotive.

Frame 14 of rail car 10 may include a first longitudinal frame member 46 spaced laterally apart from a second longitudinal frame member 48. First and second longitudinal frame members 46, 48 may extend the longitudinal length of rail car 10 terminating at the first end plate 40 at first end 28 and at the second end plate 42 of second end 30 of rail car 10. First and second longitudinal frame members 46, 48 may have exterior side panels 47 and 49, respectively, which may extend longitudinally along the outer side of first and second longitudinal frame members 46, 48 and may terminate short of end plates 40 and 42 to allow rotational movement of extending arms 20, 22, 24, and/or 26 as discussed further herein.

Intermediate to the first and second longitudinal frame members 46, 48 may be a central frame member 50 which may likewise extend between first and second end plates 40, 42 of rail car 10. First and second longitudinal frame members 46, 48 and central frame member 50 may be connected and supported by one or more cross members 52 which may be oriented perpendicular to the longitudinal frame members 46, 48 and central frame member 50 and extend therebetween. First longitudinal frame member 46 and second longitudinal frame member 48, central frame member 50, and/or cross members 52 may be standard frame components, such as I-beams or the like, as commonly used in construction of rail car 10. According to another aspect, these components may be any suitable structural members as dictated by the specific construction of the rail car 10 and may include additional components as necessary, including tension bars, sway bars or the like. Frame 14 may further include one or more anchor plates 54 operationally connected to one or more of the longitudinal frame members 46, 48 and/or central frame member 50. As depicted in FIG. 1A, anchor plates 54 may be simultaneously connected to central frame member 50 and first and second end plates 40, 42. The anchor plates 54 may provide mounting points for additional components, such as horizontal cylinders 76 as discussed further herein.

First and second wheel assembly 16, 18 may be substantially similar in that they may have the same elements and components contained therein. The difference between first and second wheel assembly 16, 18 may be only that first wheel assembly 16 may be operationally connected to rail car 10 at or near first end 28 while second wheel assembly 18 may be operationally connected to rail car 10 at or near second end 30. Generally speaking, the wheel assemblies 16, 18 may be standard trucks or wheel assemblies (sometimes referred to as "bogies") as used in normal construction of rail cars, such as rail car 10. More particularly, first and second wheel assemblies 16, 18 may be standard wheel assemblies for attaching a plurality of wheels 56 to rail car 10. First and second wheel assemblies 16, 18 may include suspension components, steering components, and/or braking components therein.

Specifically, first and second wheel assemblies 16, 18 may include one or more mounting members 58 for operational connection to rail car 10. Mounting member(s) 58 may allow wheel assemblies 16, 18 to swivel and/or pivot to follow curvature of train tracks as discussed further below. Wheel assemblies 16, 18 may further include side frames 60 on either side of the wheel assemblies 16, 18 and a central support beam 62 which may extend laterally between the side frames 60 to allow side frames 60 to be connected to mounting member(s) 58. Collectively, the mounting members 58, side frames 60, and central support beam 62 may define a wheel assembly frame 64 which may further allow mounting of additional components thereto. Wheel assembly frame 64 may also provide the mounting points for the wheels 56. Wheel assemblies 16, 18 may thus further include suspension springs 66, brake components (not shown), and/or additional suspension components (likewise not shown) operationally connected to or otherwise carried by wheel assembly frame 64. Wheel assemblies 16, 18 may further include wheel bearings 68 and wheel axles 70 about which wheels 56 may rotate. The wheels 56 may interact with the rails 144 and may further include a wheel flange 72 which may interact with the inner edge 146 of rails 144 as discussed further below. First wheel assembly 16 may be best seen in FIG. 2, with second wheel assembly 18 being substantially identical thereto but for its placement towards second end 30 of rail car 10.

With reference to FIGS. 2-6, rail car 10 may include at least one extendable arm which may be any of first extendable arm 20, second extendable arm 22, third extendable arm 24, or fourth extendable arm 26. According to one aspect, extendable arms 20, 22, 24, 26 may be provided in opposing pairs with first extendable arm 20 situated on the first side 32 of rail car 10 and second extendable arm 22 situated on the second side 34 of rail car 10 opposite first extendable arm 20. Similarly, third extendable arm 24 may be situated on the first side 32 of rail car 10 with fourth extendable arm 26 situated on the second side 34 of rail car 10 opposite third extendable arm 24. Although depicted in the figures with first, second, third, and fourth extendable arms 20, 22, 24, 26 all present with rail car 10, it will be understood that less than four or more than four extendable arms may be provided for any particular rail car 10 as dictated by the desired implementation.

Figure 5:
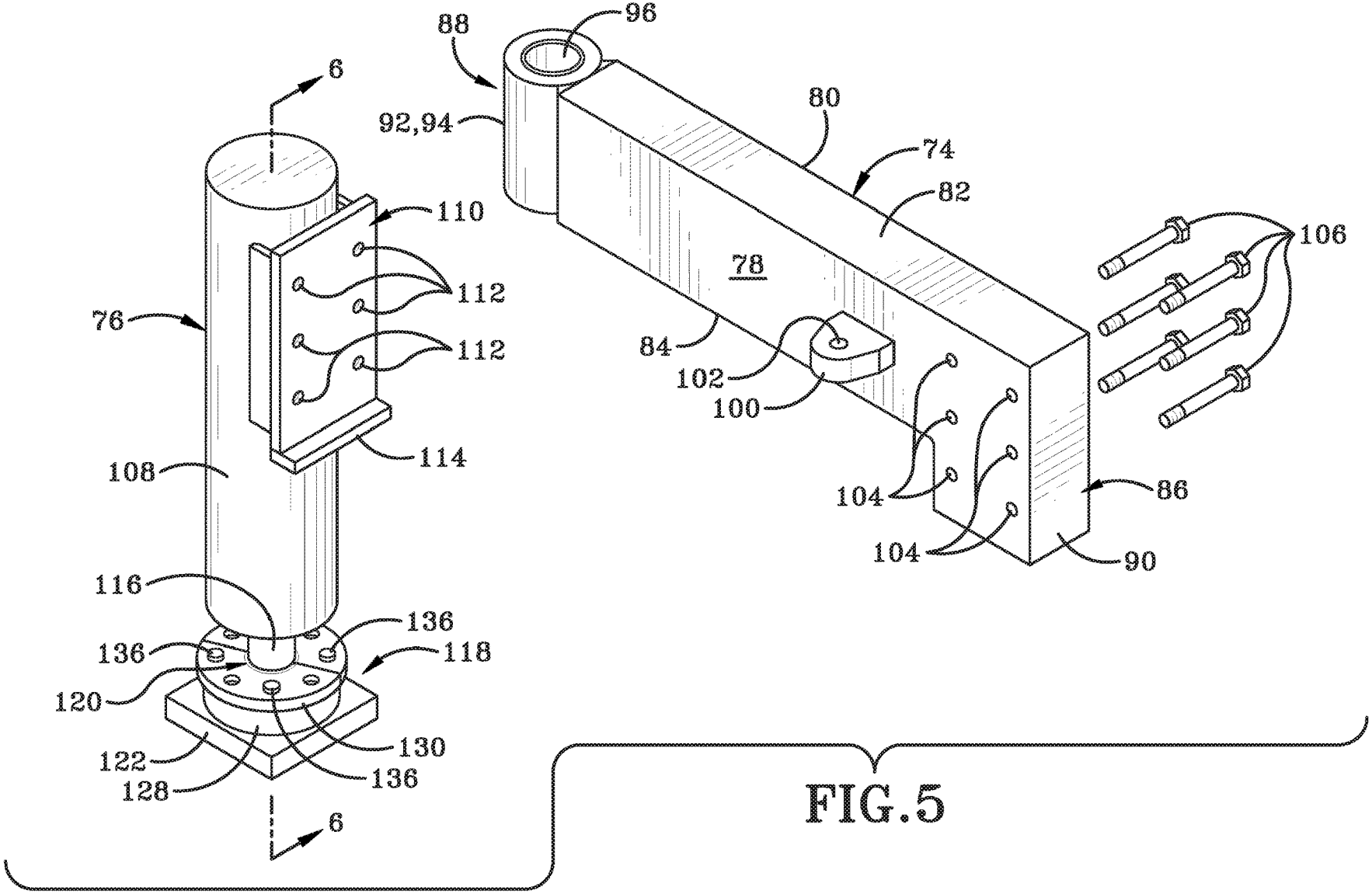
FIG. 5 is an isometric view of the components of an extendable arm of a rail car according to one aspect of the present disclosure.

First, second, third, and fourth extendable arms 20, 22, 24, 26 may be substantially similar differing only in their placement and orientation relative to rail car 10, as described herein. Each of the extendable arms 20, 22, 24, 26 may include two main elements, as best seen in FIG. 5. Specifically, each extendable arm 20, 22, 24, 26 may have an L-shaped angle iron 74 and a vertical cylinder 76. Angle iron 74 may have an inner surface 78 and an outer surface 80 spaced apart from the inner surface 78 and defining therebetween the horizontal thickness of angle iron 74. Angle iron 74 may further have a top surface 82 spaced apart from a bottom surface 84 defining therebetween the vertical thickness of angle iron 74. Angle iron 74 may have a first end 86 and a second end 88 defining therebetween the longitudinal length of angle iron 74. Angle iron 74 may also include a projection 90 which may extend from bottom surface 84 at the first end 86 of angle iron 74 and may be oriented at a substantially right angle thereto, thus giving the angle iron 74 its distinctive L-shape. According to another aspect, angle iron 74 may be of any suitable shape or configuration and is not limited to L-shaped angle iron. For example, where appropriate, angle iron 74 may be I-shaped, H-shaped, square, rectangular, circular, or any other suitable shape as dictated by the desired implementation. For simplicity, angle iron 74 will be described herein as L-shaped; however, it will be understood that the disclosure herein is applicable to other shaped angle irons as well.

Second end 88 of angle iron 74 may include a pivot mount 92 which may be a sleeve having an exterior 94 and an interior 96. Pivot mount 92 may essentially be a hollow cylinder wherein exterior 94 may form a cylindrical body thereof while interior 96 may define a through hole 102 sized to accept a pivot pin or pivot bolt as discussed further herein. Pivot mount 92 may be constructed as a portion of angle iron 74 in that it may be cast or machined from a section of angle iron 74 according to known methods. According to another aspect, pivot mount 92 may be a separately formed element and may be affixed or otherwise attached to angle iron 74 by welds, bolts, or any other suitable attachment method.

Angle iron 74 may further include a mount point 100 with a through hole 102 defined therein for operational mounting to a horizontal actuator 138 and piston 116 as discussed further below. Projection 90 of angle iron 74 may include additional through holes referred to as bolt holes 104 sized to accept a series of bolts 106 for operational connection to the vertical cylinder 76, as discussed below.

While each of first, second, third, and fourth extendable arms 20, 22, 24, 26 may have a similar structure, it will be understood that opposing extendable arms 20, 22, 24, and 26 will be mirror images of one another. More specifically, opposing angle irons 74 will be mirror images. For example, as first extendable arm 20 is disposed on first side 32 of rail car 10 with second extendable arm 22 on the second side 34 of rail car 10 and opposite first extendable arm 20, the first and second extendable arms 20, 22 may be mirror images of each other. In other terms, the inner surface 78 of extendable arm 20 may be defined as the surface of angle iron 74 facing the central frame member 50 of the rail car 10, thus the mount point 100 disposed on inner surface 78 will be on opposite sides of first extendable arm 20 and second extendable arm 22. Similarly, third extendable arm 24 may be a mirror image of fourth extendable arm 26. The orientation and position of first, second, third, and fourth extendable arms 20, 22, 24, 26 may define the specific configuration of the components described herein.

Vertical cylinder 76 may include a main body 108 and a piston 116. As discussed further herein, body 108 is contemplated to be the upper portion, or barrel, of a hydraulic actuator or the like; however, it will be understood that body 108 may be a housing or similar structure designed to contain the barrel of a hydraulic actuator therein. Therefore, for purposes of this disclosure, and for reasons of clarity, vertical cylinder 76 is referenced as though it is a hydraulic actuator with body 108 being the barrel thereof.

Vertical cylinder 76 may further include a mounting bracket 110 that may have a series of holes 112 defined therein. According to one aspect, holes 112 may be threaded for operational engagement with bolts 106 of angle iron 74. According to another aspect, holes 112 may be smooth sided and extend through the thickness of mounting bracket 110 wherein threaded nuts may be placed between mounting bracket 110 and body 108 of vertical cylinder 76 for operational engagement with bolts 106. According to yet another aspect, threaded nuts may be welded or otherwise attached to the mounting bracket 110 for operational engagement with bolts 106. Mounting bracket 110 may further include a bottom flange 114 which may extend outward therefrom and may interact with bottom surface 84 of projection 90 of angle iron 74 when angle iron 74 is coupled to vertical cylinder 76. The inclusion of bottom flange 114 may provide further support to angle iron 76 as well as may allow for proper alignment of bolt holes 104 with holes 112 for ease of installation of bolts 106.

Figure 6:
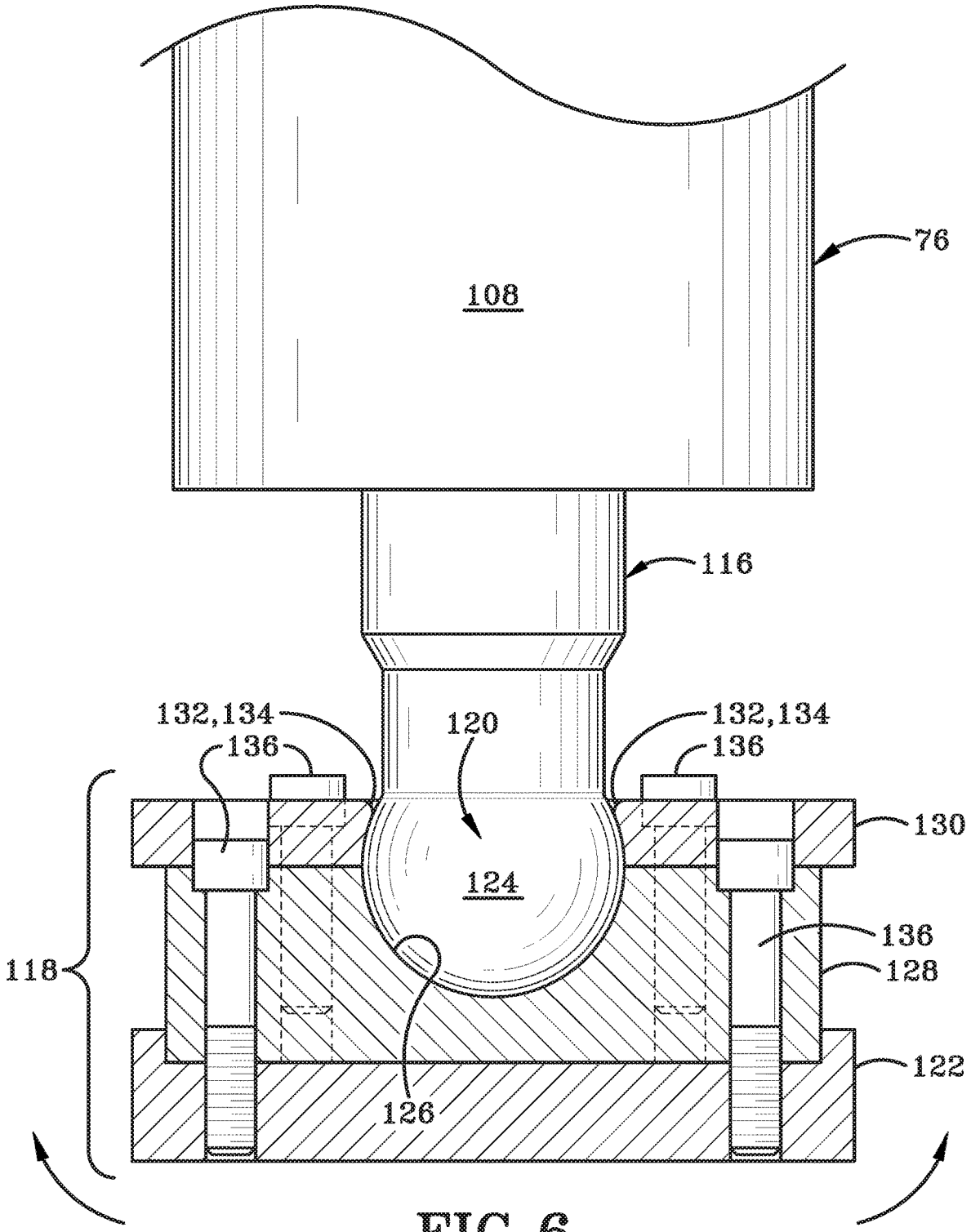
FIG. 6 is a cross-section view of a foot of an extendable arm taken along line 6-6 as indicated in FIG. 5 according to one aspect of the present disclosure.

Piston 116 of vertical cylinder 76 may further include a foot 118 that may be connected to body 108 via a ball and socket joint 120 (best seen in FIG. 6). Foot 118 may further include a lower foot plate 122, a foot body 128, and an upper foot plate 130. Upper foot plate 130 and lower foot 122 may sandwich foot body 128 therebetween which may then be secured together via bolts 136.

With reference to FIG. 6, a cross-section of the foot 118 and ball and socket joint 120 is depicted therein and will now be described in further detail. The ball and socket joint 120 may include a ball 124 disposed at the end of the piston 116 which may sit inside a socket 126 formed in foot body 128. Ball 124 may secured within socket 126 of foot body 128 by an upper foot plate 130 through an opening 132 defined therein. The sides of the opening 132 may be curved to match the outer diameter of ball 124 and the upper edge 134 of opening 132, may be rounded, chamfered, or otherwise shaped to allow foot 118 to rotate about ball 124 in any direction such that foot 118 may be angled relative to piston 116 of vertical cylinder 76. According to one aspect, foot 118 may rotate in any direction such that the angle between foot 118 and piston 116 may be in a range from approximately 5° to 15°. According to another aspect, foot 118 may rotate approximately 10° relative to piston 116 as indicated by the arrows in the bottom of FIG. 6. These angle measurements assume a starting position wherein foot 118 is perpendicular to piston 116, as shown in the figures.

Although described herein as a ball and socket joint 120, it will be understood that other suitable joints may be utilized that permit movement of foot 118 relative to piston 116 about one or more axes.

Figure 2:
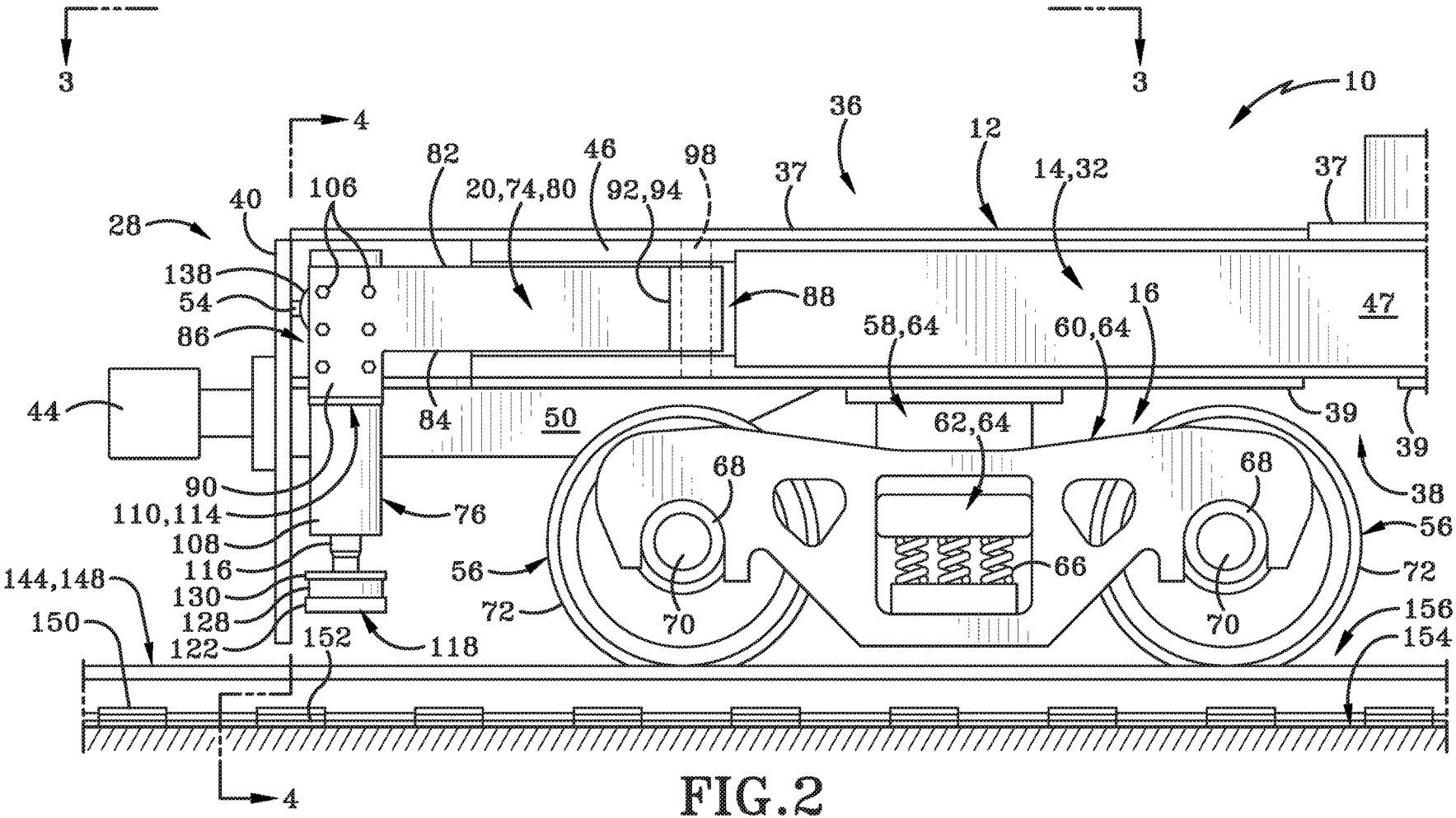
FIG. 2 is a side elevation close-up view of one end of a rail car according to one aspect of the present disclosure.
Figure 3:
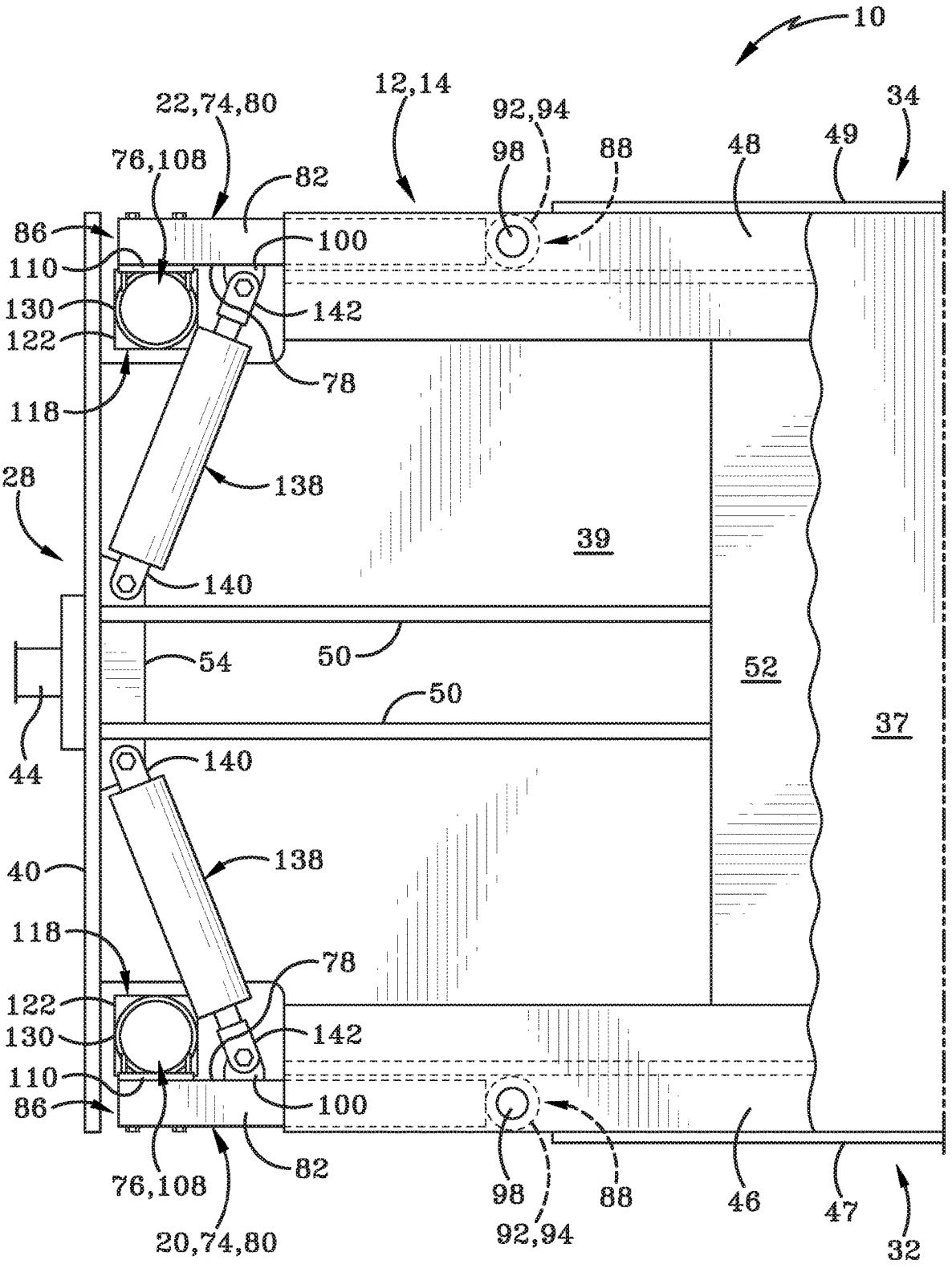
FIG. 3 is a top plan cut-away close-up view of one end of a rail car taken along line 3-3 as indicated in FIG. 2 according to one aspect of the present disclosure.
Figure 4:
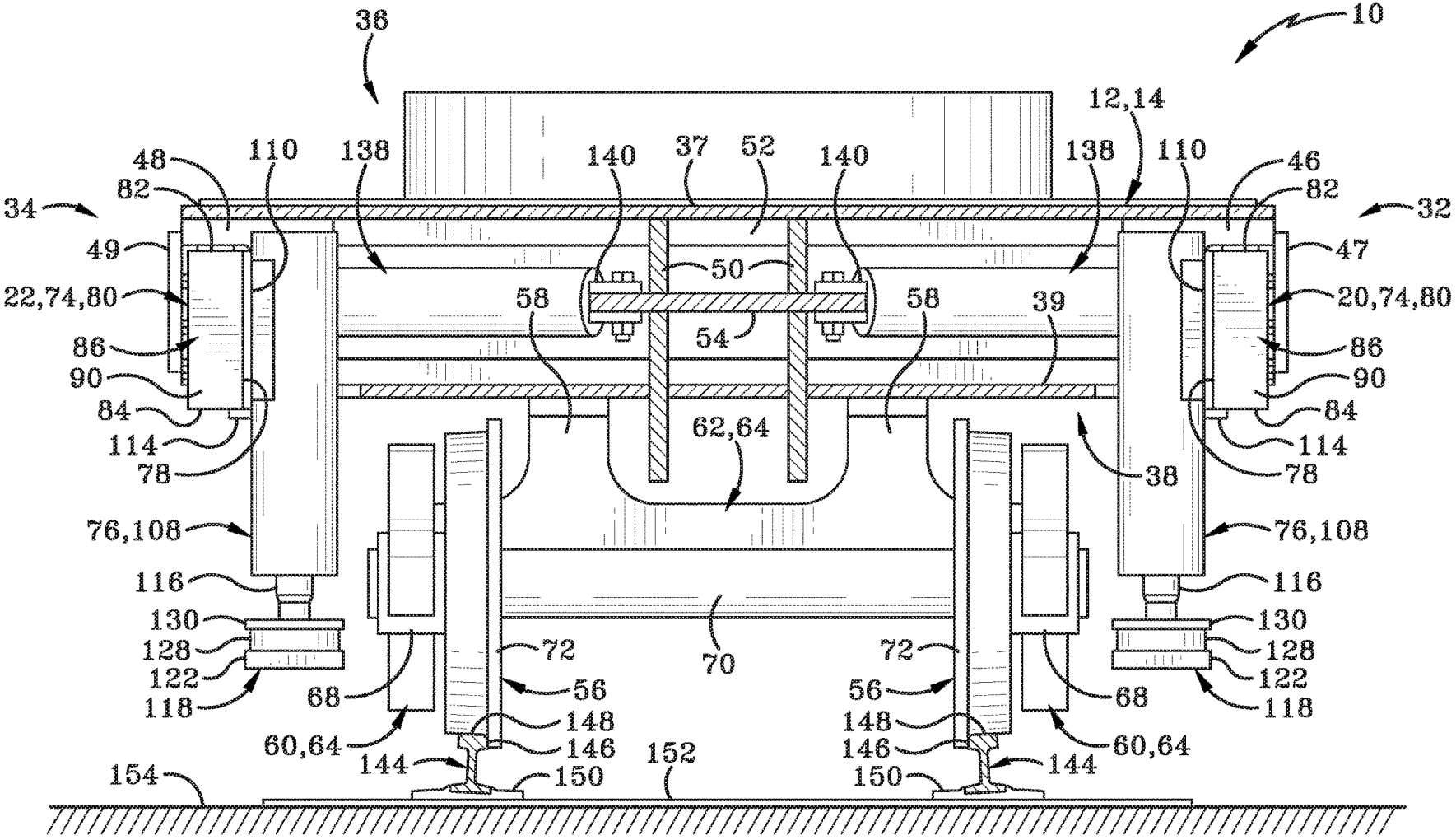
FIG. 4 is an end elevation cross-section view of a rail car taken along line 4-4 as indicated in FIG. 2 according to one aspect of the present disclosure.

With continued reference to FIGS. 2-6, but with particular reference to FIGS. 2-4, first, second, third, and fourth extendable arms 20, 22, 24, 26 may be operationally connected to the frame 14 of rail car 10 via pivot pin 98 and horizontal actuators 138. Specifically, pivot pin 98 may be inserted through interior 96 of pivot mount 92 and secured to either the first or second longitudinal frame members 46, 48 via welds, bolts, or any other suitable securing method for attaching pivot pin 98 to the longitudinal frame members 46, 48. Specifically, first and third extendable arms 20, 24 may be connected to first longitudinal frame member 46 via pivot pins 98 while second and fourth extendable arms 22, 26 may be connected to second longitudinal frame member 48 via pivot pins 98. The manner of attachment of pivot pins 98 to longitudinal frame member 46 or 48 may be substantially identical regardless of which longitudinal frame member 46 or 48 is being utilized. Mounting second end 88 of angle iron 74 to the longitudinal frame members 46, 48 via pivot pin 98 may allow first end 86 of angle iron 74 to move towards or away from the central frame member 50 of rail car 10 about a pivot axis defined by pivot pin 98.

Further supporting this movement may be horizontal actuators 138 which may be hydraulic actuators or the like. Horizontal actuators 138 may be operationally connected to anchor plate 54 of frame 13 at a first end 140 thereof and to mount point 100 via through hole 102 at a second end 142 thereof. According to one aspect, first and second ends 140, 142 of horizontal actuators 138 may be mounted to anchor plate 54 and mount point 100 via bolts, screws, pivot pins, or the like, provided the chosen connection may allow pivotal rotation between the first and second ends 140, 142 of horizontal actuator 138 and the anchor plate 54 and mount point 100, respectively, to allow pivotal movement of extendable arms 20, 22, 24, and 26.

As best seen in FIG. 3, an opening between longitudinal frame members 46, 48 and first and second end plates 40, 42 may be provided to allow vertical cylinder 76 of extendable arms 20, 22, 24, 26 to be stowed therein further allowing angle iron 74 of extendable arms 20, 22, 24, 26 to be positioned parallel to the longitudinal frame members 46, 48 when in a stowed position, as discussed below. This positioning may allow extendable arms 20, 22, 24, 26 to remain laterally inside the outermost edge of first and second sides 32, 34 of rail car 10 thus preventing any exterior projection thereof during operation of rail car 10 as discussed below.

According to one embodiment, extendable arms 20, 22, 24, and/or 26 may be configured and mounted to rail car 10 in such a manner as to extend horizontally outwards from first and second longitudinal frame members 46, 48. According to this embodiment, extendable arms 20, 22, 24, and/or 26 may forgo the pivotal attachment between pivot mount 92 and pivot bar 98 and instead utilize horizontal actuators 138 to drive the extendable arms 20, 22, 24, and/or 26 transversely out from first and second longitudinal frame members 46, 48.

Having thus described the elements and components of rail car 10, the operation of and a method of use therefore will now be described.

Figure 7A:
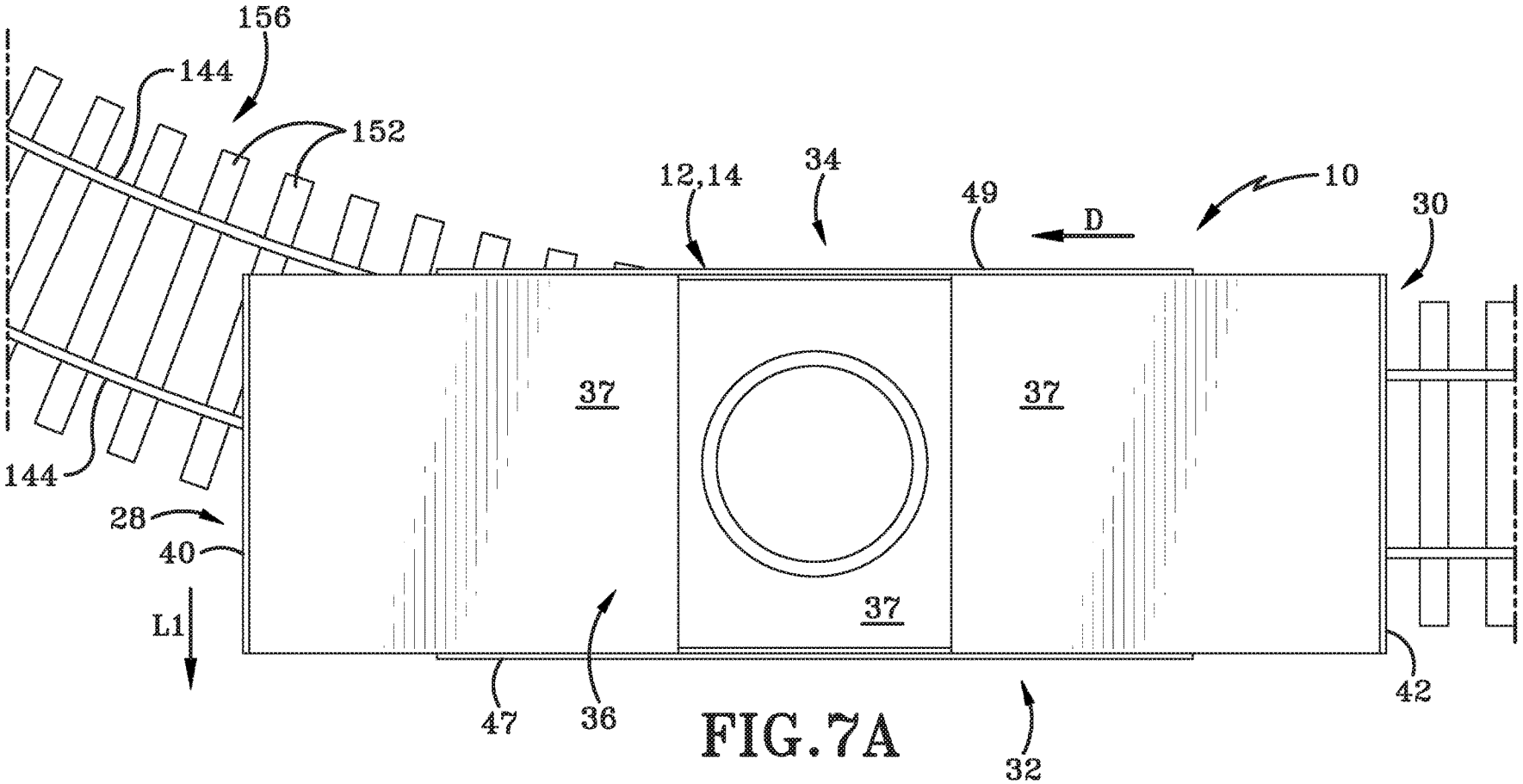
FIG. 7A is a top plan operational view of a rail car in a first derailed position according to one aspect of the present disclosure.
Figure 7B:
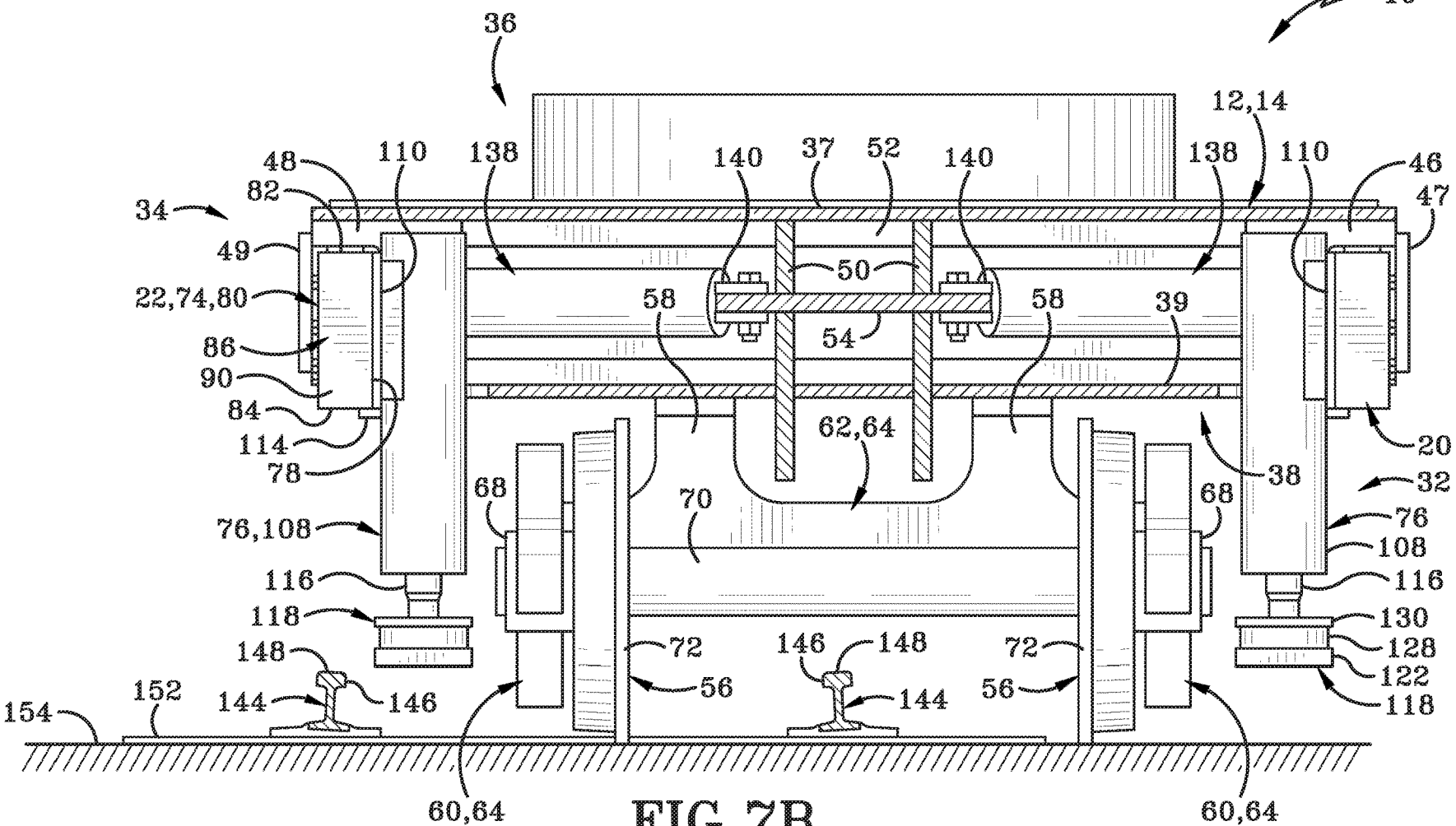
FIG. 7B is an end elevation operational cross-section view of a rail car in the first derailed position according to one aspect of the present disclosure.
Figure 7C:
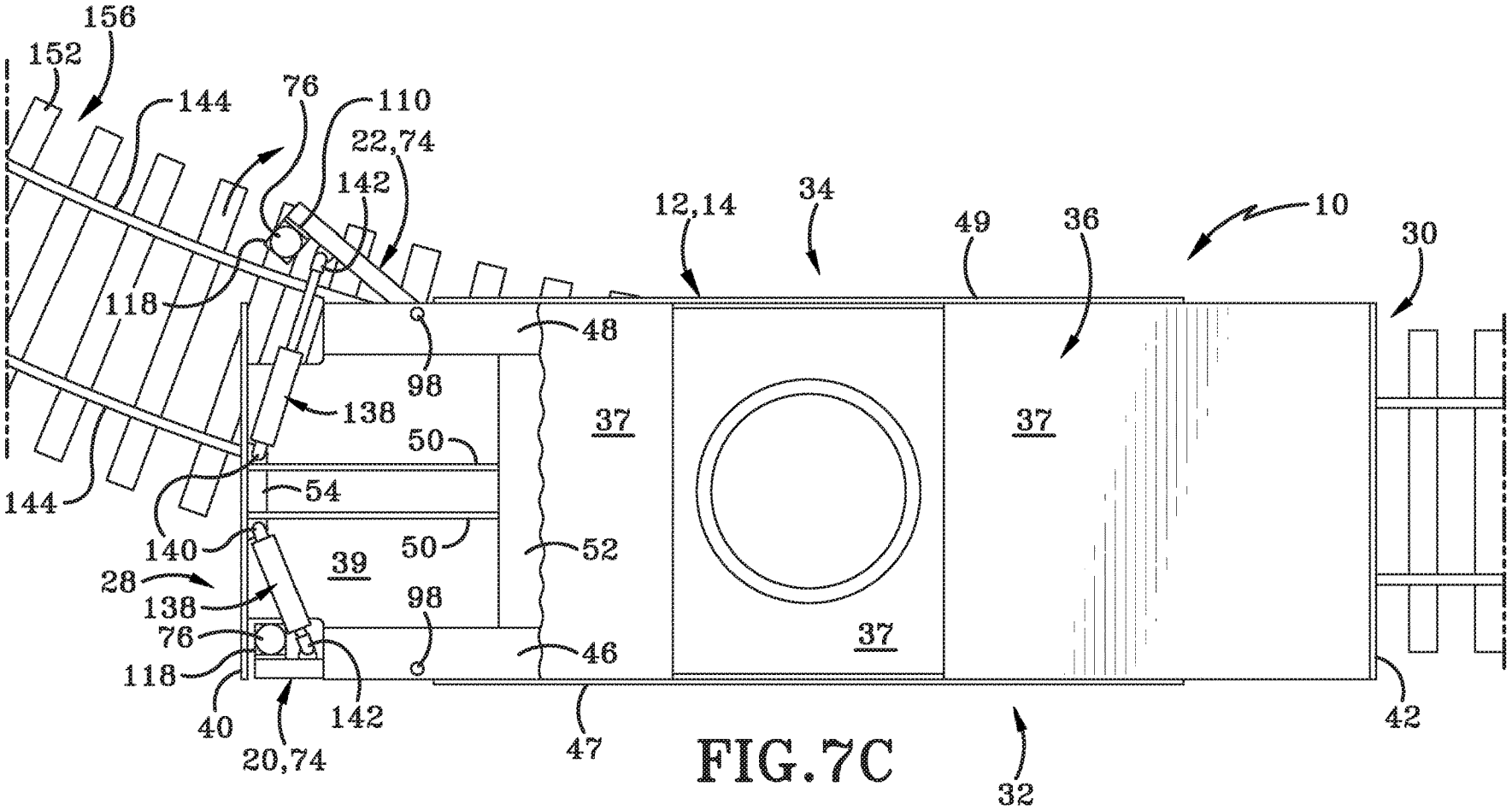
FIG. 7C is a top plan operational cut-away view of a rail car in a second derailed position according to one aspect of the present disclosure.
Figure 7D:
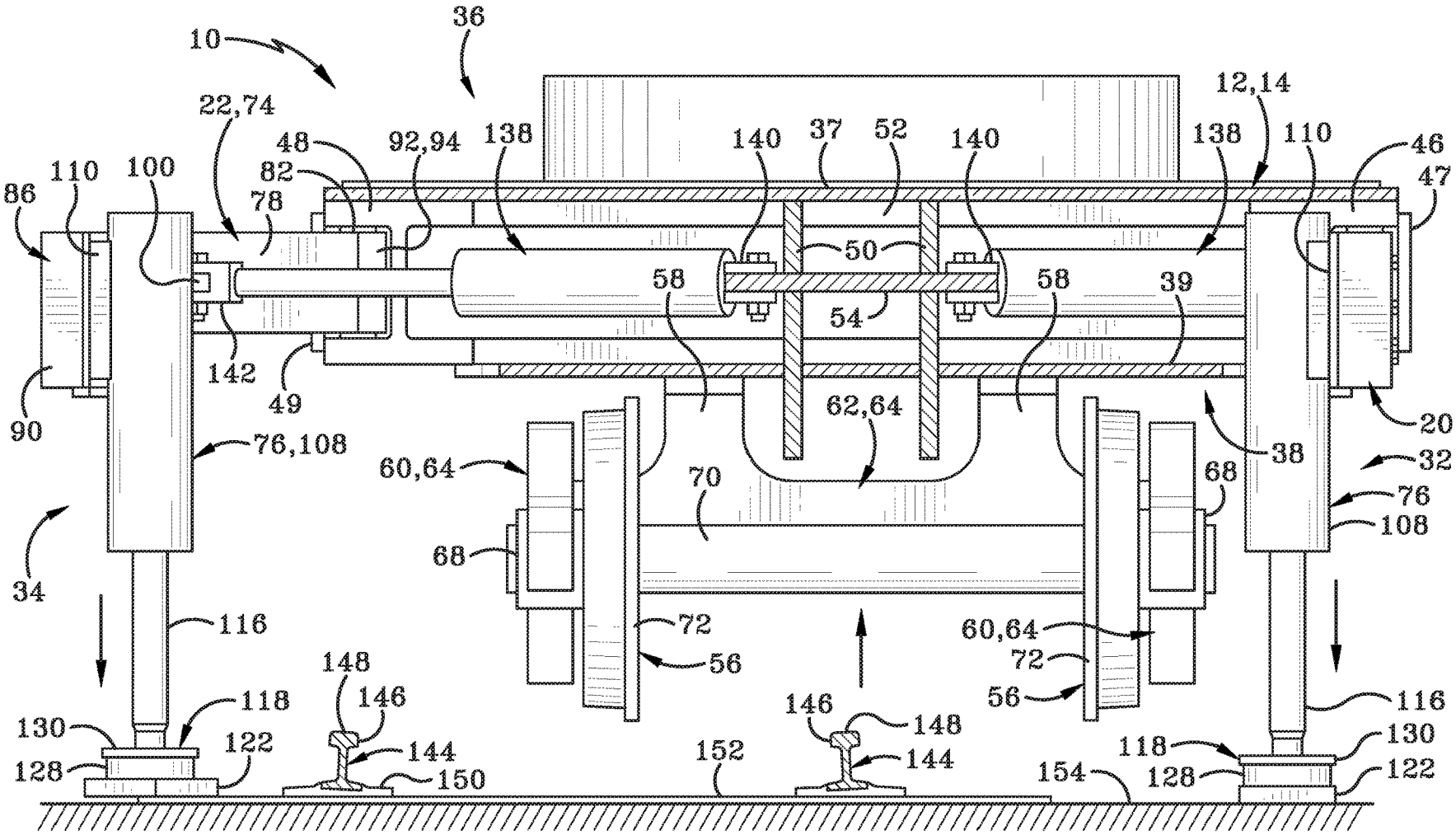
FIG. 7D is an end elevation operational cross-section view of a rail car in the second derailed position according to one aspect of the present disclosure.
Figure 7E:
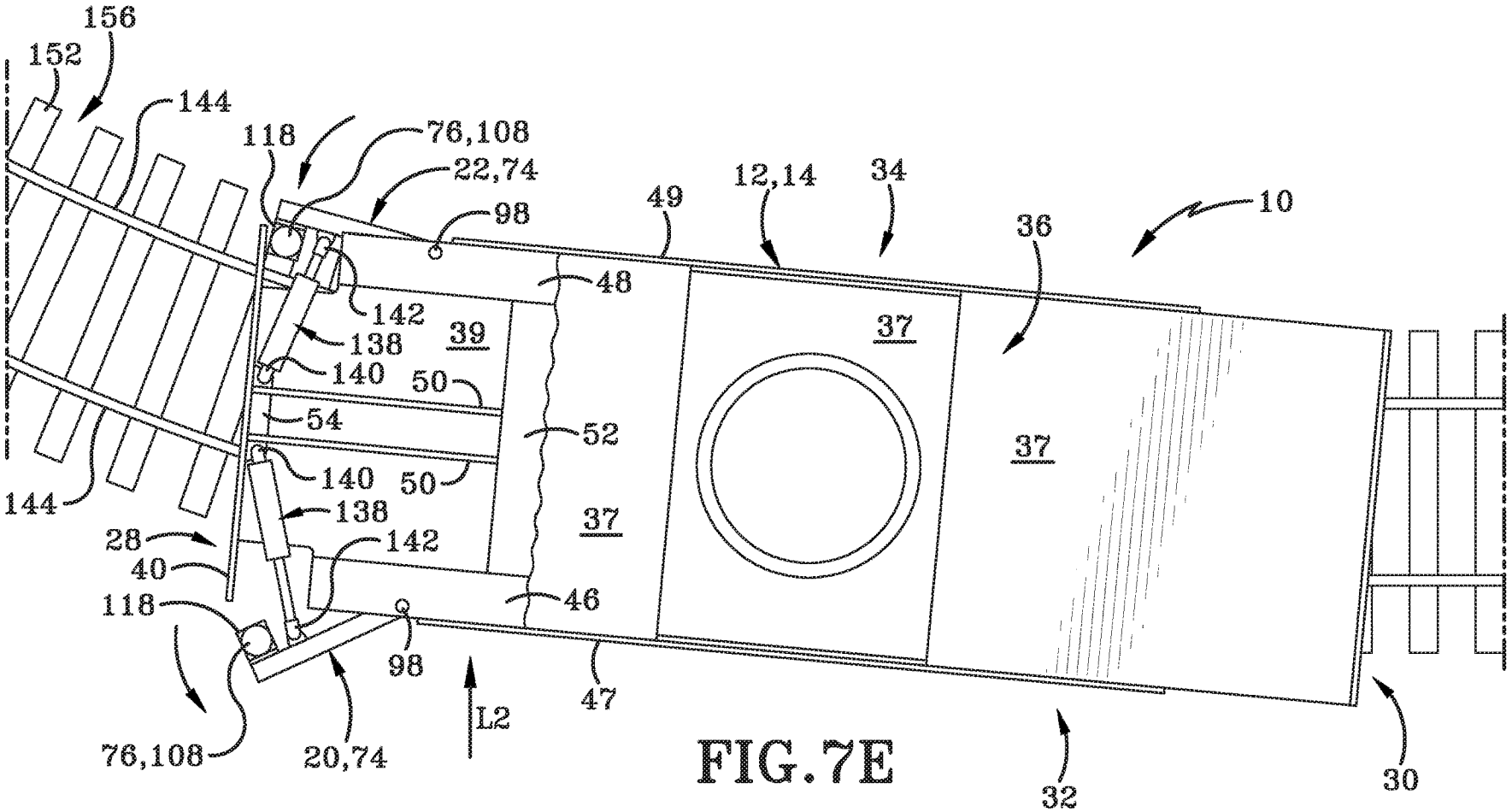
FIG. 7E is a top plan operational cut-away view of a rail car being moved from the second derailed position to a first railed position according to one aspect of the present disclosure.
Figure 7F:
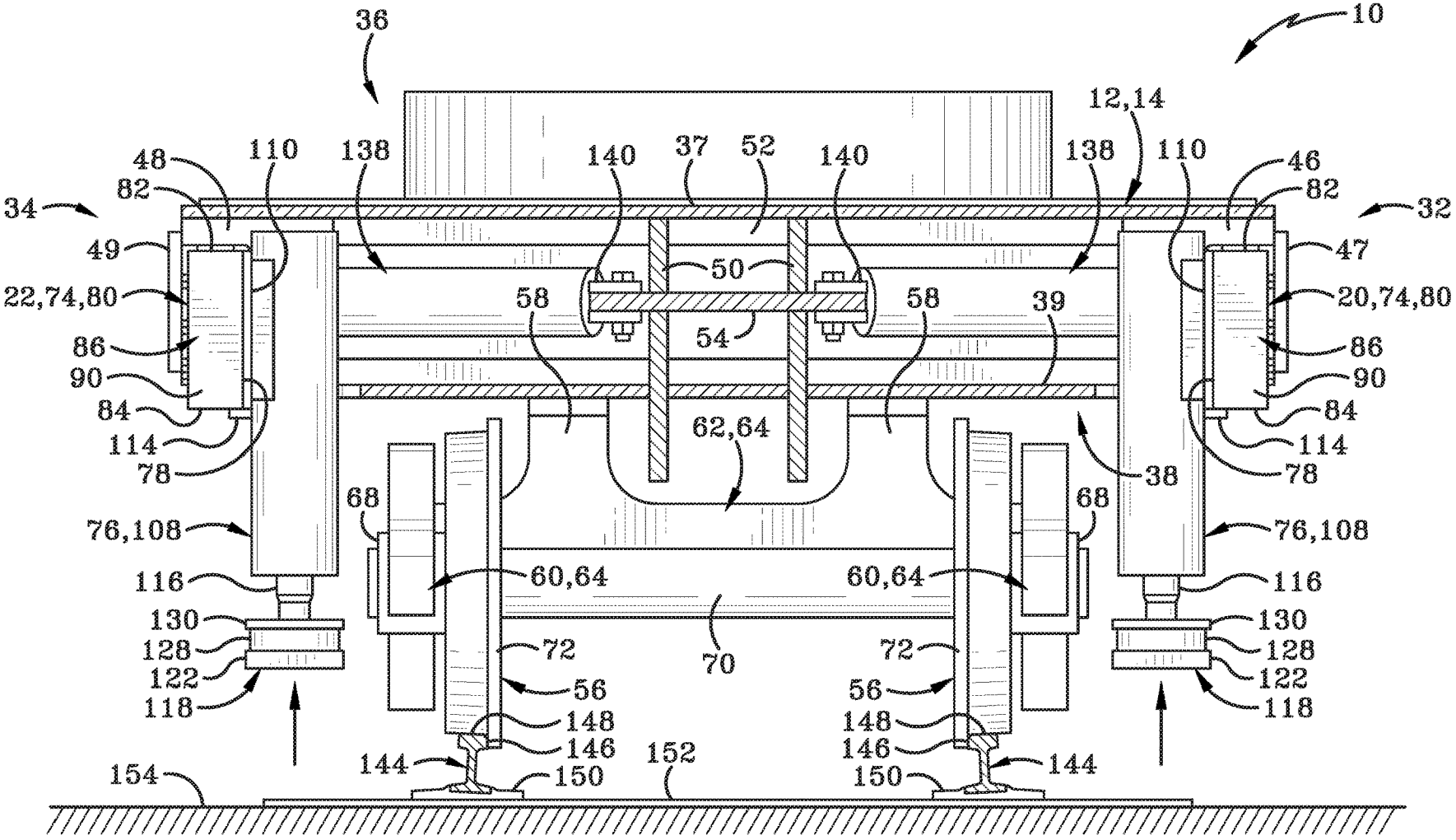
FIG. 7F is an end elevation operational cross-section view of a rail car in a first railed position according to one aspect of the present disclosure.
Figure 7G:
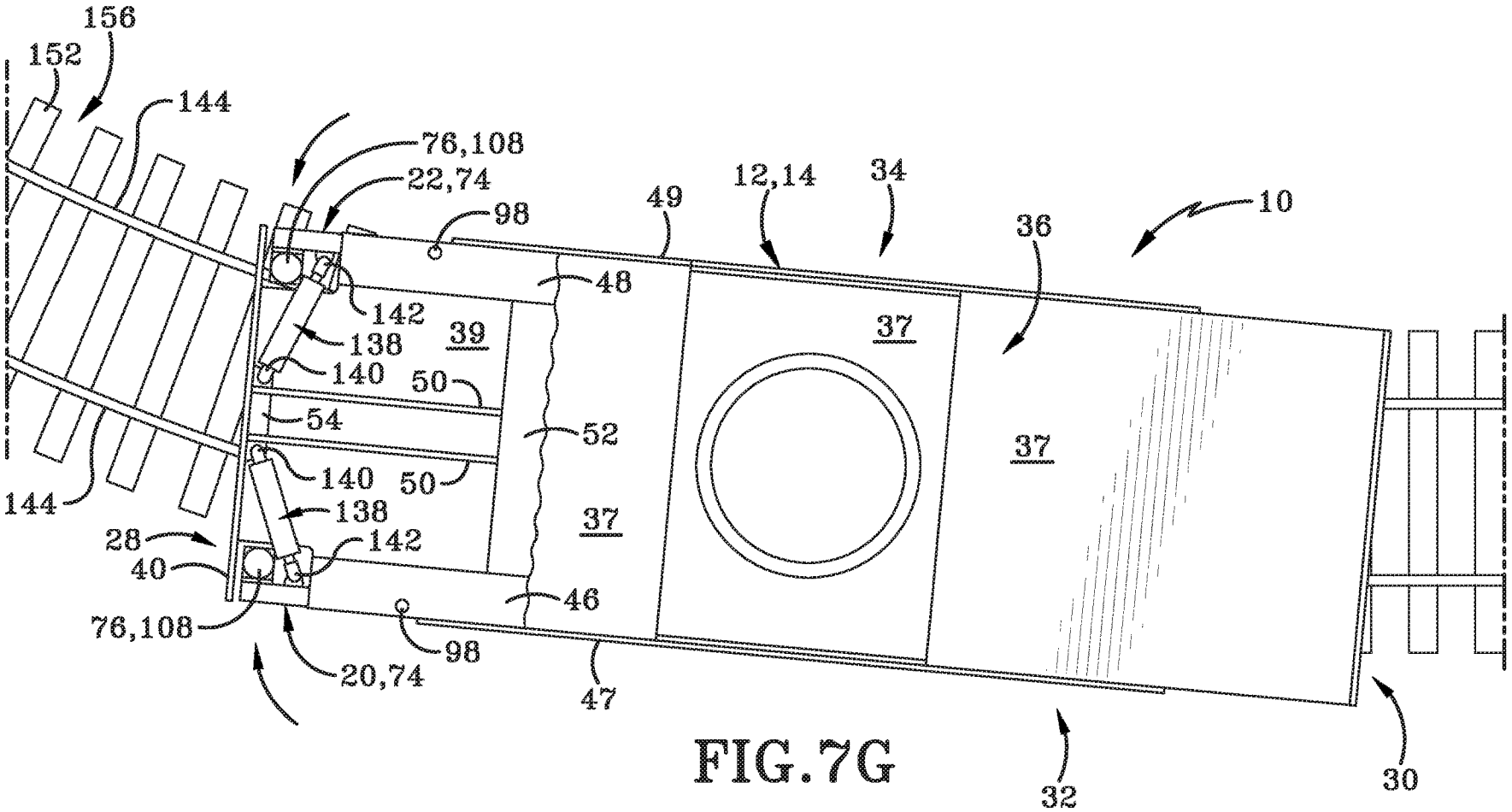
FIG. 7G is a top plan operational cut-away view of a rail car in the first railed position according to one aspect of the present disclosure.

With reference to FIGS. 7A-7G, a rail car 10 is depicted through various steps in being derailed and re-railed according to the present disclosure. Specifically, FIGS. 7A and 7B show a rail car 10 in a first derailed position with first end 28 derailed from rails 144 of train tracks 156. As used herein, a rail car 10 is considered derailed with one or more wheels 56 and/or wheel flanges 72 are disengaged from the top 148 and/or inner edge 146 of a rail 144. In a derailed position, the wheels 56 and/or wheel flanges 72 may rest on one or more of a railroad tie 152, the ground surface 154, and/or a tie plate 150 connecting railroad ties 152 to rails 144. FIGS. 7C and 7D show a rail car 10 in a second derailed position wherein extendable arms 20 and 22 at first end 28 are being deployed and first end 28 is being lifted in preparation of re-railing the car 10, as discussed below. FIG. 7E shows the first end 28 being moved laterally to align the wheels 56 with the rails 144, as discussed below. FIGS. 7F and 7G show the first end 28 being lowered to allow wheels to re-engage the rails 144 and the extendable arms 20, 22 to be stowed, as discussed herein.

Accordingly, as rail car 10 moves along the tracks in the direction of arrow D (FIG. 7A), it is not uncommon for the wheels 56 and wheel flanges 72 to become disengaged with the rail 144 as illustrated in FIG. 7B. This often occurs at a curve in the train tracks 156 wherein the momentum of rail car 10 carries it off the rails 144 along the direction of travel D such that the first end 28 of rail car 10 may skip the track and move laterally relative to the train tracks 156 as indicated by arrow L1 in FIG. 7A. Any time the wheels 56 or wheel flanges 72 disengage from the rails 144, this is referred to as a derailing or a derail event. It is common for minor derail events to occur in a railyard or factory wherein the wheels 56 disengage from the rails 144 by only a small distance, for example, a few inches to a few feet. As best shown in FIG. 7B, when rail car 10 is derailed, wheels 56 and/or wheel flanges 72 often then sit on the ground surface 154 surrounding train tracks 156. It is also common for the wheels 56 to come to rest on one or more tie plates 150 and/or railroad ties 152. Current practices for dealing with a derailed event tend to involve bringing in heavy lifting equipment, such as cranes or the like to raise one or both ends 28 and/or 30 of a rail car 10 to align the wheels 56 with rails 144 before lowering the rail car 10 back down onto the tracks 156. This process is time-consuming and costly, and often results in significant delays for use of the tracks 156 and the areas surrounding the tracks 156 as the derailed car 10 cannot otherwise be moved out of the way while the lifting equipment is brought in and the car 10 is re-railed. Further, the lifting equipment itself may cause delays in that it may occupy or otherwise block the tracks 156 and surrounding areas making them unusable during the re-railing efforts. Where the derail even occurs in a factory, this can cause multiple machines, or even the entire factory, to be taken offline while the rail car 10 is re-railed.

With reference to FIGS. 7C-7G, the re-railing process is depicted and will be discussed in more detailed. As illustrated in the figures, the examples provided herein involve a rail car 10 wherein a single end, i.e., first end 28, has disengaged from the rails 144 of the train tracks 156. Although described and discussed for purposes of simplicity of disclosure as a process for re-railing one end of the rail car 10, it will be understood that this process may be utilized to realign and re-rail a rail car 10 that has derailed at both ends including both the first and second wheel assemblies 16, 18 and wheels 56 thereof being disengaged from rails 144.

Once a derail event has occurred, the extendable arms 20, 22, 24, and/or 26 provided at the specific end, i.e., first end 28 or second end 30, of rail car 10 that has derailed may be extended from the sides 32, 34 of rail car 10 via the horizontal actuators 138. The horizontal actuators 138 may rotate the extendable arms 20, 22, 24, and/or 26 from a stowed position wherein angle iron 74 is substantially parallel to the longitudinal frame member 46 or 48 to which it is attached, to a deployed position wherein the angle iron 74 rotates about pivot pin 98 to an angle relative to the longitudinal frame member 46 or 48. According to one aspect, the angle iron 74 may rotate to any angle relative to the associated longitudinal frame member 46 or 48 in a range from approximately 1° to approximately 90°. According to another aspect, angle iron 74 may rotate about pivot pin 98 to pre-chosen and/or preset increments of angles, for example, increments of every five degrees from zero to 90°. The specific angle to which angle iron 74 may be rotated in any particular derail event may be dictated by the facts of that particular event. For example, angle iron 74 and the associated extendable arms 20, 22, 24, and/or 26 may only need rotated a few degrees for derail events of the magnitude of a few inches while the angle iron 74 may need to be rotated to a higher degree for larger derail events of the magnitude of a few feet. For even larger derail events, such as those exceeding the fully deployed reach of extendable arms 20, 22, 24, and/or 26, the extendable arms 20, 22, 24, and/or 26 may be operated in tandem to "walk" the rail car 10 back to the train tracks 156 for proper alignment, a process for which is discussed further below.

As depicted in FIGS. 7C-7D, first end 28 is shown disengaged from rails 144, the process for re-railing will be further described with reference to that first end 28 and the first and second extendable arms 20 and 22, respectively. As seen in FIG. 7C, the second extendable arm 22 may be rotated out from its stowed position to a deployed position while first extendable arm 20 may likewise be rotated from its stowed position to a deployed position. The extendable arms 20, 22 may be operated simultaneously or in succession as dictated by the facts of a particular derail event. With reference to FIG. 7D, once the extendable arms 20 and 22 have been rotated to their desired position, vertical cylinder 76 may then extend piston 116 and foot 118 to contact the ground surface 154. Once the foot 118, or more particularly foot plate 122, is in a secure position against ground surface 154, the vertical cylinder 76 may continue to extend the piston 116 downward which may in turn raise rail car 10 up to a sufficient height wherein the wheels 56 and wheel flanges 72 can clear the top surface 148 of rails 144. The foot 118 being rotatable about the ball 124 of the ball and socket joint 120 may allow for a secure footing even on slightly uneven ground. This is important because it is common for railroad tracks 156 to be slightly elevated above the surrounding ground surface 154, thus the ground surface 154 is commonly sloped at a slight angle down and away from the railroad tracks 156 necessitating the adjustment of foot 118 to provide a secure foundation for lifting rail car 10.

With reference now to FIG. 7E, once the first end 28 or rail car 10 is raised to a sufficient height wherein the wheels 56 and wheel flanges 72 may clear the top surface 148 of rails 144, the second extendable arm 22 may be rotated back towards the second longitudinal frame member 48 while the first extendable arm 20 may be rotated further out from first longitudinal frame member 46 to drive first end 28 of rail car 10 laterally in a direction of arrow L2. This lateral movement may facilitate the alignment of the wheel flange 72 with the inner edge 146 of rails 144 and the wheels 56 with the top surface 148 of rails 144 thereby allowing first end 28 of rail car 10 to be lowered by retracting the piston 116 into the vertical cylinder 76.

With reference to FIGS. 7F-7G, once rail car 10 is lowered back into position wherein the wheels 56 are contacting the top surface 148 of rails 144 and the wheel flanges 72 are adjacent to and against the inner edge 146 of rails 144, the piston 116 may be retracted fully into vertical cylinder 76 and the first and second extendable arms 20 and 22 may be rotated back into their stowed position wherein the angle irons 74 thereof are substantially parallel to the first and second longitudinal frame members 46 and 48. At this point, rail car 10 is now re-railed and able to be moved or otherwise operated normally.

It will be understood that the above process may be performed similarly, but in a mirrored fashion, to re-rail a rail car 10 that has derailed to the opposite side of tracks 156. For example, first extendable arm 20 may retract while second extendable arm 22 may deploy further to move the first end 28 of rail car 10 in a lateral direction opposite arrow L2.

According to one aspect where both first and second ends 28 and 30 of rail car 10 are simultaneously derailed, any or all of first, second, third, and/or fourth extendable arms 20, 22, 24, and/or 26 may be deployed in a manner similar to that described above to raise rail car 10 above the height of rails 144 and then moving rail car 10 laterally to realign wheels 56 and wheel flanges 72 with the top surface 148 and inner edge 146 of rail 144, respectively.

In instances where rail car 10 is disengaged with the tracks 156 by a distance of more than a few feet, specifically by a distance exceeding the length of angle iron 74 such that wheels 56 of rail car 10 cannot be realigned with rails 144 in a single lateral movement, rail car 10 may utilize any or all of first, second, third, and/or fourth extendable arms 20, 22, 24, and/or 26 to "walk" itself back to a position of alignment with rails 144. According to one aspect, the walking motion of rail car 10 may be accomplished by first raising rail car 10 similar to the process described above and moving rail car 10 laterally a first distance equal to the full extent permitted by the length of first, second, third, and/or fourth extendable arms 20, 22, 24, 26. Then rail car 10 may be lowered to contact the ground surface 154 before redeploying the appropriate extendable arms 20, 22, 24, and/or 26 to a second position and re-raising rail car 10. Once raised a second time, extendable arms 20, 22, 24 and/or 26 may again move rail car 10 laterally a second distance towards the rails 144 and repeating this process until wheels 56 are aligned with rails 144.

Alternatively, according to another aspect, rail car 10 may be raised utilizing any or all of first, second, third, and/or fourth extendable arms 20, 22, 24, and/or 26 and moved laterally according to the process above, however, according to this aspect, rather than lowering rail car 10 all the way to the ground surface 154, the foot 118 of one of the extendable arms 20, 22, 24, and/or 26 may be raised until it is not in contact with the ground surface 154 and that particular extendable arm 20, 22, 24, and/or 26 may be redeployed to a second position. That foot 118 may then be re-lowered to contact the ground surface 154 followed by subsequent repetition for the remaining extendable arms 20, 22, 24, and/or 26. According to this aspect, rail car 10 may walk itself back to a position of alignment with rails 144, however, it is important that rail car 10 be supported by at least three of the four extendable arms 20, 22, 24, 26 while the fourth arm 26 is being raised and redeployed to prevent rail car 10 from tipping or otherwise being damaged. Accordingly, this process may be more time-consuming than raising and lowering rail car 10 as discussed above.

It will be understood that the particular facts of any individual derail event, including the distance from the rails 144 that rail car 10 has disengaged, as well as the stability of and/or damage to the ground surface 154 surrounding the rail car 10 will dictate the particular method chosen for realigning and re-railing rail car 10 onto the tracks 156. It is contemplated, however, that the processes described herein may be readily applied and/or adapted for use in nearly all minor derailment situations.

Further, in major derailment scenarios where rail car 10 has sustained significant damage or is otherwise disoriented relative to the rails 144 of train tracks 156, extendable arms 20, 22, 24, 26 may be utilized to assist in efforts in clearing or removing rail car 10 from blocking some or all of train tracks 156. For example, in an instance where a rail car 10 has been rolled onto one of its sides, 32 or 34, the extendable arms 20, 22, 24, 26 on that particular side 32 or 34 may be raised to help right rail car 10 and return it to an upright position.

While highly damaged rail cars 10 are expected to be removed from the tracks 156 utilizing heavy equipment, the extendable arms 20, 22, 24, 26 and associated structures may further assist with those efforts as well. By way of another example, in a major derail event where one or more of the wheel assemblies 16, 18 are sheared from the frame 14 of rail car 10, or are otherwise damaged beyond the point of being usable, extendable arms 20, 22, 24, 26 may be utilized to raise the rail car 10 to a sufficient height to allow proper attachment to a crane or other lifting equipment.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A rail car comprising:

a body having a frame;

a first longitudinal frame member on a first side of a centerline of the body;

a second longitudinal frame member on a second side of the centerline of the body;

a first wheel assembly having at least one pair of wheels adapted to engage a pair of rails of a train track;

a second wheel assembly having at least one pair of wheels adapted to engage the pair of rails of the train track;

a first extendable arm pivotally connected to the first longitudinal frame member, the first extendable arm having a first foot;

a first hydraulic actuator operable to move the first extendable arm relative to the body;

a second extendable arm pivotally connected to the second longitudinal frame member, the second extendable arm having a second foot; and a second hydraulic actuator to move the second extendable arm relative to the body wherein the first and second extendable arms are rotatable between a fully stowed position wherein the first and second extendable arms are substantially parallel to the respective longitudinal frame member, and a fully extended position wherein the first and second extendable arms are oriented at approximately 90° relative to the respective longitudinal frame member.

2. The rail car of claim 1 further comprising:

a third extendable arm pivotally connected to the first longitudinal frame member, the third extendable arm having a third foot;

a third hydraulic actuator operable to move the third extendable arm relative to the body;

a fourth extendable arm pivotally connected to the second longitudinal frame member, the fourth extendable arm having a fourth foot; and a fourth hydraulic actuator operable to move the fourth extendable arm relative to the body;

wherein the third and fourth extendable arms are rotatable between the fully stowed position wherein the third and fourth extendable arms are substantially parallel to the respective longitudinal frame member, and the fully extended position wherein the third and fourth extendable arms are oriented at approximately 90° relative to the respective longitudinal frame member.

3. The rail car of claim 2 wherein each of the first foot, second foot, third foot, and fourth foot further comprise:

a hydraulic actuator operable to raise and lower the first foot, second foot, third foot, and fourth foot relative to its respective extendable arm.

4. The rail car of claim 3 wherein at least one foot of the first foot, the second foot, the third foot, and the fourth foot and its respective actuator are operable to raise the rail car from a first position wherein at least one of the first and second wheel assemblies are in contact with the ground to a second position wherein the at least one of the first and second wheel assemblies is above the rails of the train tracks.

5. A method of re-railing a rail car comprising:

rotating at least one extendable arm carried by the rail car from a stowed position wherein the at least one extendable arm is substantially parallel to a longitudinal frame member of the rail car to a deployed position wherein the at least one extendable arm is oriented at an angle between one and ninety degrees relative to the longitudinal frame member of the rail car;

raising at least a portion of the rail car to a sufficient height to allow a wheel assembly carried by the rail car to be above the height of a rail pair of a train track via the at least one extendable arm and the foot;

realigning at least one wheel of the wheel assembly with at least one of the rails in the rail pair via the at least one extendable arm;

lowering the raised portion of the rail car until the at least one wheel contacts at least one rail in the rail pair via the foot; and rotating the at least one extendable arm from the deployed position to the stowed position.

6. The method of claim 5 wherein rotating the at least one extendable arm between the stowed and deployed positions further comprises:

rotating a first extendable arm between the stowed position and the deployed position; and rotating a second extendable arm between the stowed position and the deployed position.

7. The method of claim 5 further comprising:

lowering a foot from the at least one extendable arm to contact a ground surface prior to raising the at least a portion of the rail car; and raising the at least a portion of the rail car via the at least one extendable arm and the foot.

8. The method of claim 6 further comprising:

lowering a foot from each of the first and the second extendable arms to contact the ground surface prior to raising the at least a portion of the rail car; and raising the at least a portion of the rail car via the first and second extendable arms and associated feet.

9. A method of re-railing a rail car comprising:

moving at least one of a plurality of extendable arms carried by the rail car from a stowed position to a first deployed position;

lowering a foot from each of the plurality of extendable arms to contact a ground surface;

raising at least a portion of the rail car to a sufficient height to allow a wheel assembly carried by the rail car to be above the height of a rail pair of a train track via the plurality of extendable arms and the feet;

moving the raised portion of the rail car a first distance laterally relative to the train track via the plurality of extendable arms;

raising the foot from a first arm of the plurality of extendable arms;

moving the first arm of the plurality of extendable arms to a second deployed position;

lowering the foot from the first arm of the plurality of extendable arms to contact the ground surface;

raising the foot from a second arm of the plurality of extendable arms;

moving the second arm of the plurality of extendable arms to a third deployed position;

lowering the foot from the second arm of the plurality of extendable arms to contact the ground surface; and moving the raised portion of the rail car a second distance laterally relative to the train tracks without lowering the raised portion of the rail car.

10. The method of claim 9 further comprising:

raising the foot from a third arm of the plurality of extendable arms;

moving the third arm of the plurality of extendable arms to a fourth deployed position;

lowering the foot from the third arm of the plurality of extendable arms to contact the ground surface;

raising the foot from a fourth arm of the plurality of extendable arms;

moving the fourth arm of the plurality of extendable arms to a fifth deployed position;

lowering the foot from the fourth arm of the plurality of extendable arms to contact the ground surface; and moving the raised portion of the rail car a third distance laterally relative to the train tracks without lowering the raised portion of the rail car.

11. The method of claim 9 wherein the second distance is the distance from the termination of the first distance to the rails of the train tracks, the method further comprising:

realigning at least one wheel of the wheel assembly with at least one of the rails in the rail pair; and lowering the raised portion of the rail car until the at least one wheel contacts at least one rail in the rail pair.

12. The method of claim 10 wherein moving the first through fourth extendable arms further comprises:

one of rotating and sliding the first through fourth extendable arms relative to the rail car.

* * * * *